United States Patent [19]

Symonds et al.

[11] Patent Number: 4,565,573

[45] Date of Patent: Jan. 21, 1986

[54] PURIFICATION OF MOLTEN LEAD

[75] Inventors: Richard D. Symonds; Joseph E. Clapp, both of Salem; Kenneth Buckley, Viburnum, all of Mo.

[73] Assignee: Amax Inc., Greenwich, Conn.

[21] Appl. No.: 725,713

[22] Filed: Apr. 22, 1985

[51] Int. Cl.[4] ..... C22B 13/00

[52] U.S. Cl. ..... 75/77; 266/216

[58] Field of Search ..... 75/66, 77; 266/216

[56] References Cited

U.S. PATENT DOCUMENTS 2,723,913 11/1955 Wall ..... 420/564
2,728,656 12/1955 Neher ..... 420/564
2,854,333 9/1958 Thomas ..... 420/564
3,700,430 10/1972 Landt ..... 75/66

*Primary Examiner*—Peter D. Rosenberg
*Attorney, Agent, or Firm*—Michael A. Ciomek; Eugene J. Kalil

[57] ABSTRACT

Molten sodium is alloyed with molten lead by using apparatus comprising a vessel adapted to hold molten sodium under gas pressure and a conduit to convey molten sodium under the impetus of gas pressure from a point low in the vessel to a point beneath the lead surface so as to effect alloying of sodium with lead without escape of sodium vapor.

2 Claims, 2 Drawing Figures

PURIFICATION OF MOLTEN LEAD

The present invention is directed to improved apparatus and process for treating impure molten lead with sodium.

BACKGROUND OF THE INVENTION AND THE PRIOR ART

The principal lead mineral extracted and refined for the production of primary lead is galena, which, depending upon the nature of the deposit in which it is found, will contain greater or lesser amounts of other metal values including, inter alia, arsenic, antimony, copper, silver, gold, etc. In order to produce pig lead of marketable purity and/or to promote overall economy in refining, these metal values are recovered. Briefly, the lead sulfide concentrate is roasted to remove sulfur and melted in a suitable reduction furnace to produce an impure lead base bullion. The refinery flow sheet will be adapted to handle the particular bullion being refined and can vary considerably depending upon the kind and amount of impurity to be removed. A useful device for carrying out many refining operations is the drossing kettle which may take the form of a hemispherical container made of steel which may be heated by a furnace. The kettle may be fitted with a stirrer. Because of the high density of lead, the products of the various refining reactions will almost invariably report to the dross on the surface of the lead bath. The dross thus acts to concentrate metals removed from the bath by refining reactions. The dross may be removed readily from the bath and be worked up to recover metal values therefrom.

Sulfur is generally present in basic lead bullion and a convenient way to remove such sulfur and other impurities is to treat the sulfides contained with metallic sodium. This has been accomplished by stirring the bath to create a vortex and inserting sticks of sodium metal into the bath. Because of the high density of molten lead, it is difficult to create a deep vortex in a lead bath unless energetic stirring is used. This creates an energy cost. Even with energetic stirring, there is a tendency for escape of sodium vapor. Since sodium melts at 97.5° C. and lead melts at 327° C., sodium exerts an appreciable vapor pressure at the temperature of the lead bath. This is undesirable from the environmental viewpoint and for personnel safety reasons and leads to losses of sodium, a relatively expensive material.

The invention provides a solution to the aforementioned problems and provides increased recovery of sodium, elimination of the dust and fume problem, reduced cost and improved safety and handling ease.

SUMMARY OF THE INVENTION

The invention provides apparatus for introducing molten sodium beneath the surface of a lead bath comprising a vessel for holding molten sodium under pressure, a container for molten lead such as a drossing kettle, a molten sodium conduit having an inlet near the bottom of the molten sodium vessel communicating with a probe end fastened to the molten lead container for delivering molten sodium through the probe end at a controllable depth beneath the surface of the lead bath. The sodium advantageously is delivered through the conduit by pressurized inert gas admitted at or near the top of the sodium vessel to exert downward pressure on the molten sodium surface to push molten sodium into and through the conduit to a point beneath the surface of the molten lead bath.

DETAILED DESCRIPTION OF THE INVENTION

Figure 1:
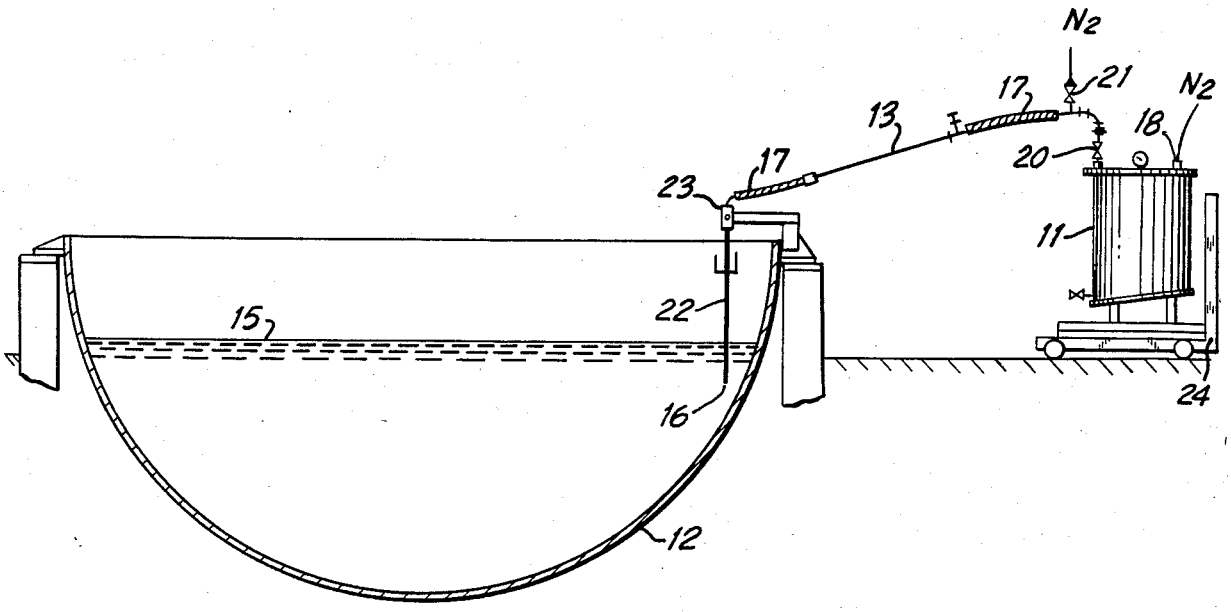
FIG. 1 depicts an overall elevational view of apparatus contemplated in accordance with the invention.
Figure 2:
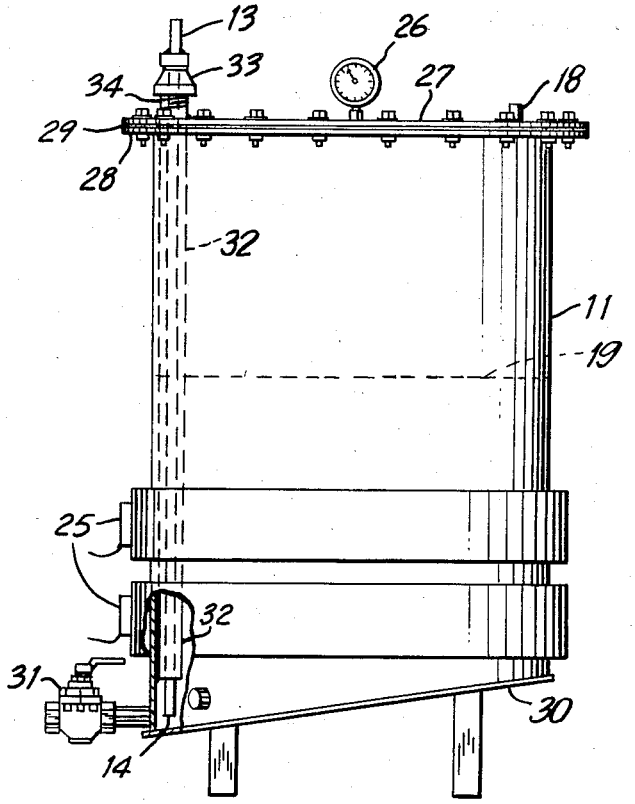
FIG. 2 depicts in more detail a liquid sodium vessel contemplated in accordance with the invention.

The invention will now be described in conjunction with the drawing in which reference character 11 depicts the molten sodium container or vessel, 12 depicts in section a drossing kettle for lead, a conduit 13 communicating from an opening 14 near the bottom of vessel 11 (see FIG. 2) to a probe end which delivers molten sodium to a point beneath the surface 15 of the lead level in kettle 12 as indicated at 16. Conduit 13 may conveniently be made from lengths of iron or steel pipe joined by lengths of flexible stainless steel hose as indicated at 17. Sodium is forced from vessel 11 by admitting pressurized inert gas, such as dry nitrogen through port 18 in vessel 11, thereby pressurizing the space within vessel 11 above the sodium liquid level indicated by reference character 19 in FIG. 2. Under the influence of gas pressure within vessel 11, liquid sodium is forced up inlet end 14 of conduit 13, thence through conduit 13 to exit through probe end 16 of conduit 13 at a point below the surface of the lead bath in kettle 12. To prevent escape of sodium vapor from the lead surface in kettle 14, probe end 16 should be located approximately nine inches or more beneath the lead bath surface 15 in kettle 14. Because of the high lead density, nine inches of plumbostatic pressure translates to about ninety inches of water, or about one-fourth of an atmosphere. Conduit 13 is fitted with flow control valve 20 which may be utilized to control sodium flow therein and with vent 21 which may be used to vent gas therefrom. Probe portion 22 of conduit 13 advantageously is fixed in place as by bracket 23 which is adjustable so that the probe end 16 will be maintained at an appropriate distance beneath the lead bath surface. Vessel 11 may be mounted upon scale 24 so that the rate of sodium delivery can be measured. Vessel 11 is fitted with heating means 25 and preferably is insulated to reduce heat loss. A pressure gage 26 may be provided. Vessel 11 may be produced from rolled steel plate and may have a bolted-on steel lid 27 fastened to flange 28. A gasket 29 preferably is employed. As shown, the bottom 30 of vessel 11 slopes toward drain valve 31. Other valving means, not shown, may be employed to feed fresh molten sodium into vessel 11. A convenient measure for fixing conduit means 13 at the correct point within vessel 11 is illustrated in FIG. 2. Pipe 32, larger in inner diameter than conduit 13, is fixed to the wall of vessel 11 as by welding; and conduit 13 is fastened within pipe 32 as shown through use of reducer 33 welded to conduit 13 and threadably engaged at 34 to pipe 32 in gas-tight fashion. In this manner, inlet end 14 can be located firmly at a point about one-half inch above the bottom of vessel 11. Portions of conduit 13 not heated by the contents of vessel 11 and kettle 12 can be heated as by resistance tape and can be insulated to prevent freezing of sodium.

An example will now be given:

Sodium vessel 11 was substantially filled with solid sodium blocks. The vessel was purged of oxygen, the sodium was melted and heated to a temperature between about 215° and 235° F. About 300,000 pounds of molten lead were admitted to kettle 12. The lead temperature was maintained at about 950° F. by a furnace about kettle 12. Probe end 16 of conduit 13 was located about nine inches below the molten lead surface. About 350 pounds of molten sodium were pumped into the molten lead in about four minutes with no escape of sodium vapor above the surface of the lead bath. Pressure within vessel 11 was about 10 pounds per square inch. The dross which formed was skimmed off.

In this manner, lead can be alloyed with liquid sodium with the production of little or no gas, smoke, vapor, etc.

It is to be appreciated that the invention can be used to form a molten prealloy of sodium in lead, e.g., up to 1% or more, by weight, of sodium can be alloyed with molten lead and the molten alloy can then be used to desulfurize solid dross produced in prior processing and stockpiled. As an example, 300,000 pounds of molten lead having about 3,000 pounds of sodium therein held at about 950° F. in drossing kettle provided with a mechanical mixer, such as that represented by reference character 12 in the drawing can be used to treat preheated (e.g. 900° F.) stockpiled dross scooped onto the surface thereof. Sodium from the molten alloy reacts with sulfur in the dross and the lead content of the dross is recovered in the lead bath. Substantially all the sodium in the lead-sodium alloy is utilized.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. The process for recovering lead from lead dross which comprises the steps of (1) establishing a bath of molten lead in a heated vessel, said molten lead bath having a surface, (2) introducing molten sodium at a point sufficiently below said lead bath surface that said sodium alloys with said lead and does not escape from said bath, said sodium becoming alloyed with said lead up to about 1%, by weight, of said molten lead, (3) placing preheated lead dross upon the surface of said alloyed molten lead bath (4) reacting said molten lead alloy with said dross to remove sulfur from said dross, recover the lead content of said dross in said bath and thereby utilize substantially all the sodium content of said alloyed lead bath.

2. The process in accordance with claim 1 wherein liquid sodium is forced from a vessel containing sodium by inert gas pressure applied to the surface of a body of liquid sodium contained in said vessel through a conduit having an opening adjacent the bottom of said liquid sodium body to a probe end opening at the other end of said conduit located at a point beneath the surface of said lead bath.

* * * * *